US011560688B2

(12) United States Patent
Marchetta et al.

(10) Patent No.: US 11,560,688 B2
(45) Date of Patent: Jan. 24, 2023

(54) DEVICE FOR AUTOMATIC CONNECTION BETWEEN A TOOL AND A TOOL HOLDER OF A CONSTRUCTION OR PUBLIC WORKS MACHINE

(71) Applicant: GROUPE MECALAC, Annecy-le-Vieux (FR)

(72) Inventors: Henri Marchetta, Sevrier (FR); Maxime Boni, Sillingy (FR); Nicolas Putod, Pringy (FR)

(73) Assignee: GROUPE MECALAC, Annecy-le-Vieux (FR)

( * ) Notice: Subject to any disclaimer, the term of this patent is extended or adjusted under 35 U.S.C. 154(b) by 346 days.

(21) Appl. No.: 16/756,024

(22) PCT Filed: Oct. 10, 2018

(86) PCT No.: PCT/FR2018/052512
§ 371 (c)(1),
(2) Date: Apr. 14, 2020

(87) PCT Pub. No.: WO2019/081831
PCT Pub. Date: May 2, 2019

(65) Prior Publication Data

US 2020/0291599 A1 Sep. 17, 2020

(30) Foreign Application Priority Data

Oct. 26, 2017 (FR) ..... 1760095

(51) Int. Cl.
*E02F 3/36* (2006.01)

(52) U.S. Cl.
CPC ..... *E02F 3/3654* (2013.01); *E02F 3/3645* (2013.01); *E02F 3/3636* (2013.01)

(58) Field of Classification Search
CPC ..... E02F 3/3636; E02F 3/3645; E02F 3/3654
See application file for complete search history.

(56) References Cited

U.S. PATENT DOCUMENTS

2002/0157287 A1* 10/2002 Mieger ..... E02F 3/3654 37/468
2006/0271263 A1* 11/2006 Self ..... G05D 1/0033 701/2
2020/0308802 A1* 10/2020 Thomas ..... E02F 3/3631

FOREIGN PATENT DOCUMENTS

DE 102004014824 A1 10/2005
DE 102014119748 A1 6/2016
(Continued)

OTHER PUBLICATIONS

International Search Report issued in PCT Patent Application No. PCT/FR2018/052512 dated Feb. 1, 2019.

*Primary Examiner* — Saul Rodriguez
*Assistant Examiner* — Brendan P Tighe
(74) *Attorney, Agent, or Firm* — Marshall, Gerstein & Borun LLP

(57) ABSTRACT

The automatic connection device includes a fixed connection plate, that is attached to or integrated with the tool holder and stationary relative to same, a movable connection plate, that is mounted movably on the tool so as to be able to both pivot and slide relative to same, and a centering device provided on the tool holder and the tool such that, when said tool is mounted and assembled mechanically on the tool holder, the connection plates are mutually centered and the electrical, pneumatic and/or hydraulic couplers of same are mutually connected so as to connect at least one of the electrical, pneumatic and/or hydraulic networks of the tool to that of the tool holder.

13 Claims, 6 Drawing Sheets

(56) References Cited

FOREIGN PATENT DOCUMENTS

| | | | |
|---|---|---|---|
| EP | 0963688 | A2 | 12/1999 |
| EP | 1624116 | A2 | 2/2006 |

* cited by examiner

DEVICE FOR AUTOMATIC CONNECTION BETWEEN A TOOL AND A TOOL HOLDER OF A CONSTRUCTION OR PUBLIC WORKS MACHINE

TECHNICAL FIELD

The present invention relates to the technical field of construction and public-works equipment. It deals with a device for automatic connection between a tool and a tool holder for construction equipment used for example in connection with urban construction sites, railway work, and service and maintenance construction sites.

More specifically the invention relates to a device with which to automatically connect the electrical, pneumatic and/or hydraulic networks of a tool with that of a tool holder when they are mechanically assembled, without outside action of the driver of the equipment.

BACKGROUND OF THE INVENTION

The construction or public-works equipment of the handling, loading or lifting equipment type, or loader-excavator earthmoving type or similar comprises working equipment in the form of an articulated arm at the end of which a work tool is installed.

The work tools are generally made up of a bucket, shovel, or loader, or of a hydraulic tool (for example a rock breaker, auger, brush cutter, etc.) or even others, depending on the type of use. Generally, the changing and mounting of these work tools turns out to be a long and difficult operation, considering both the weight of each of them and also the conditions under which these changes are done, most often on-site, meaning on construction sites.

On average, during a workday, the construction equipment driver can need to change the tools several tens of times. These steps of mounting and dismounting require immobilizing the equipment for several minutes each time. Accumulated, this time immobilized represents a non-negligible loss of productivity.

In order to simplify mounting the tool on the free end of the stick of construction or public-works equipment, the Applicant developed several solutions, in particular a quick and reversible device for attachment of a tool to construction equipment wherein the tool holder comprises two pairs of holding axles extending laterally and mobile by moving closer or farther apart by means of a locking cylinder, whereas the tool comprises at least two pairs of receiving parts for which the openings are facing and each intended to receive one of the holding axles. Because of this device, the tool can be locked and unlocked on the tool holder by means of the locking cylinder by reversibly changing the distance separating pairs of holding axles between an extended position of the locking cylinder in which the holding axles are stopped at the bottom of an associated receiving part and a withdrawn position of the locking cylinder in which the holding axles can be removed from the receiving parts.

Thus, an equipment driver could take a tool and assemble it or disassemble it with the tool holder, with considerable freedom in the positioning of the equipment relative to the tool, while also minimizing the risks of dropping the tool during assembly operations.

Depending on the tool mounted on the tool holder, the driver must sometimes get out of the vehicle to come connect the electric, hydraulic and/or pneumatic networks from the tool to those on the tool holder because today, there is no satisfactory device for automatic connection between a tool and a tool holder on the stick of construction or public-works equipment such as previously described.

In fact, during placement of the tool on the tool holder by means of the previously mentioned device, once a first pair of holding axles has been inserted in a pair of receiving parts, the second pair of holding axles is inserted in the other pair of receiving parts by a pivoting movement of the tool holder relative to the tool, in order to place the second pair of holding axles facing the openings of the other pair of receiving parts, followed by a sliding movement in order to insert the second pair of holding axles into the bottom of the receiving parts.

However, current electric, hydraulic and/or pneumatic automatic connection devices between a tool and a tool holder are not suited to a pivoting motion of the tool holder relative to the tool, but only a straight translational movement bringing the tool holder closer to the tool.

Furthermore, these automatic connection devices are equipped with damping or movement compensation devices typically comprising springs, silent blocks or compensation cylinders, and consequently result in automatic connection devices that are complicated, expensive and unreliable.

SUMMARY OF THE DISCLOSURE

The object of the present invention consequently aims to remedy the disadvantages from the prior art by proposing a new automatic connection device with which to connect and automatically couple at least one of the electric, pneumatic and/or hydraulic networks of a tool with at least one of those of a tool holder equipped on the free end of the stick of construction or public-works equipment when said tool is mechanically mounted and assembled on the tool holder by at least one pivoting movement of the tool holder relative to the tool, or vice versa.

Another object of the present invention also aims to provide construction or public-works equipment comprising a stick equipped with a tool holder carrying a tool and equipped with an automatic connection device suited to a pivoting movement of the tool holder relative to the tool or vice versa during the mutual assembly thereof.

The objects assigned to the invention are achieved by means of an automatic connection device with which to connect and automatically couple at least one of the electric, pneumatic and/or hydraulic networks of the tool with at least one of those of the tool holder equipped on the free end of the stick of construction or public-works equipment when said tool is mechanically mounted and assembled on the tool holder, where this automatic connection device comprises:

a first connection plate provided on the tool, comprising at least one electric, pneumatic and/or hydraulic coupler accessible from the outside and connected to at least one of the electric, pneumatic and/or hydraulic networks of said tool;

a second connection plate provided on the tool holder, comprising at least one electric, pneumatic and/or hydraulic coupler accessible from the outside and connected to at least one of the electric, pneumatic and/or hydraulic networks of said tool holder;

a centering device provided on the tool holder and/or on the tool such that, when said tool is mechanically mounted and assembled on the tool holder, the first and second connection plates are mutually centered and the couplers thereof are mutually connected, so as to connect at least one of the electric, pneumatic and/or hydraulic networks of the tool to that of the tool holder; wherein at least one of the connection plates, called fixed connection plate, is attached or integral to the tool or the tool holder on which it is provided so as to be immobile relative thereto; and the other connection plate, called movable connection plate, is mounted mobile on the tool or the tool holder on which it is provided so as to be mobile both in pivoting and sliding relative thereto.

Since the movable connection plate is mobile both in pivoting and sliding relative to the tool or tool holder on which it is provided, it is suited to all types of movement aiming to assemble a tool on a tool holder.

This new automatic connection device is particularly suited to the device from the Applicant previously described allowing placement of a tool on a tool holder without having to get out of the public-works equipment.

With it, the electric, pneumatic and/or hydraulic coupling can be done automatically at the same time as the mechanical coupling of the tool on the tool holder.

This new automatic connection device is also suited to all devices for placement of a tool on a tool holder because it is used to adapt all types of movement of the tool holder relative to the tool or inversely is used to mount a tool on the tool provided at the free end of the stick of construction or public-works equipment.

Since the fixed connection plate is immobile relative to the tool or the tool holder on which it is provided, it is attached or integral to the tool or the tool holder, without needing a damping or movement compensation device.

The two connection plates are connected during assembly of the tool and the tool holder, without risk of disconnection, and only one of the connection plates is mobile, but without requiring springs, silent blocks, compensation cylinders or other expensive and unreliable elements.

Generally, the simplicity and robustness of the automatic connection device from the invention advantageously allows it to be reliable, strong and low cost.

According to a sample implementation of the invention, the centering device guides the movement of the movable connection plate relative to the fixed connection plate along a curved trajectory when the tool is mechanically mounted and assembled on the tool holder. Thus, the centering device is also suited for a pivoting movement of the tool holder relative to the tool or vice versa for connecting the connection plates when the tool is mechanically mounted and assembled on the tool holder.

According to another sample implementation of the invention, the centering device comprises at least one first guiding element provided on the tool immediately by or on the first connection plate, and at least one second guiding element provided on the tool holder immediately by or on the second connection plate.

According to an additional sample implementation of the invention, the automatic connection device comprises two guiding elements provided on either side of the first connection plate and two other guiding elements provided on either side of the second connection plate. By providing the guiding elements in pairs, better centering of the two connection plates can be provided in order for the mutual connection thereof.

According to a sample implementation the invention, the first or second guiding element is a projecting guiding finger, whereas the other guiding element is a receiving housing for said guiding finger, provided for housing the guiding finger with a lateral play less than 2 mm, preferably less than 1 mm and more preferably less than 0.5 mm.

According to another sample implementation of the invention, each guiding finger has the shape of a plate having a thickness included between 5 and 30 millimeters, preferably comprised between 8 and 20 millimeters and more preferably comprised between 10 and 15 millimeters. A guiding element is very strong and fully suited to use on construction sites where tools are typically very heavy and could be handled fairly roughly.

According to an additional sample implementation of the invention, each guiding finger has a free end which narrows to a point shape, followed by a straight median portion continuing along the longitudinal axis of the guiding finger and ending in a flared base provided for mounting of the guiding finger on or immediately by the connection plate on which it is provided. With this shape, the mutual engagement of the guiding fingers in the receiving housing associated therewith, and then, once this engagement is made, progressively centering the two connection plates are made easier.

According to a sample implementation of the invention, the tapered free end of each guiding finger comprises an inclined plane directed forward and opposite a straight part extending along the longitudinal axis of the guiding finger. This shape is particularly suited for pivoting the front far end of the tool holder toward the tool or vice versa, corresponding to the preferred assembly mode of the tool on the tool holder.

According to another sample implementation of the invention, each receiving housing comprises a flared entry through which the guiding finger penetrates, followed by a straight part extending along the longitudinal axis of the receiving housing in order to receive said guiding finger at least partially. With this shape, the mutual engagement of the guiding fingers in the receiving housing associated therewith, and then, once this engagement is made, progressively centering the two connection plates are made easier.

According to an additional sample implementation of the invention, each guiding finger and each receiving housing are provided in a vertical plane and they extend along the longitudinal axis of the stick of the construction or public-works equipment.

According to a sample implementation of the invention, each guiding finger is provided on the movable connection plate. Thus, the guiding fingers are mobile, just like the movable connection plate.

According to another sample implementation of the invention, each guiding finger has an overall straight shape.

According to an additional sample implementation of the invention, the first connection plate is mounted mobile on the tool whereas the second connection plate is attached or integral to the tool holder.

According to a sample implementation of the invention, the at least one electric, pneumatic and/or hydraulic coupler of the fixed connection plate is a female coupler and the at least one electric, pneumatic and/or hydraulic coupler on the mobile connection plate is a male coupler.

According to another sample implementation, the first connection plate comprises an identification chip, while the second connection plate comprises a chip reader. Thus, when connecting the tool on the tool holder, the chip reader can read the information which is found on the chip in order to identify the tool and automatically adjust the equipment so that the tool can be used according to the manufacturer's instructions.

According to an additional sample implementation of the invention, the identification chip is an RFID chip.

According to a sample implementation of the invention, the mobile connection plate comprises a base mounted mobile on the tool or the tool holder, where this base comprises cutouts each forming a guiding opening and provided on either side of the movable connection plate, and said tool or tool holder comprises projecting elements, where each of these projecting elements is housed sliding in one of the cutouts. This mounting of the mobile base on the projecting elements of the tool or tool holder is what allows the connection plate to be movable.

According to another sample implementation of the invention, each projecting element has the shape of a pair of substantially cylindrical guiding rollers each with a diameter that is substantially equal to and slightly less than that of the internal height of the cutouts.

According to an additional sample implementation of the invention, when the tool is mounted on the tool holder, the cutouts of the base are located in a plane substantially orthogonal to the longitudinal axis of the stick of the construction or public-works equipment.

According to a sample implementation the invention, each cutout has an oblong shape.

According to another sample implementation the invention, each cutout has an end transversely flared relative to the longitudinal axis of the cutout, where this flare extends in the direction opposite to the tool holder when the tool is mounted on the tool holder. This flare provides a freedom of movement of the mobile base relative to the tool or the tool holder when these two elements mutually pivot while they are already engaged by the centering device.

When the tool is assembled and locked on the tool holder, the projecting elements of the tool or tool holder are located in the portion of the cutout which does not have a flared end, which allows immobilizing the movable connection plate relative to the fixed connection plate.

The objectives assigned to the invention are also achieved by means of construction or public-works equipment comprising a stick equipped with a tool holder carrying a tool, where the equipment comprises an automatic connection device such as previously described.

BRIEF DESCRIPTION OF THE DRAWINGS

Other characteristics and advantages of the present invention will be seen more clearly from the following description, provided with reference to the appended drawings, provided by way of non-limiting examples, in which.

DETAILED DESCRIPTION

The structurally and functionally identical elements shown in several different figures are assigned the same numerical or alphanumerical reference.

Front or rear refers to the usual conventions involving vehicles. Thus, the pivoted stick at the end of which a work tool is installed is usually located at the front of construction equipment. In the figures, in profile views, the front is to the right and the rear is to the left.

Figure 1:
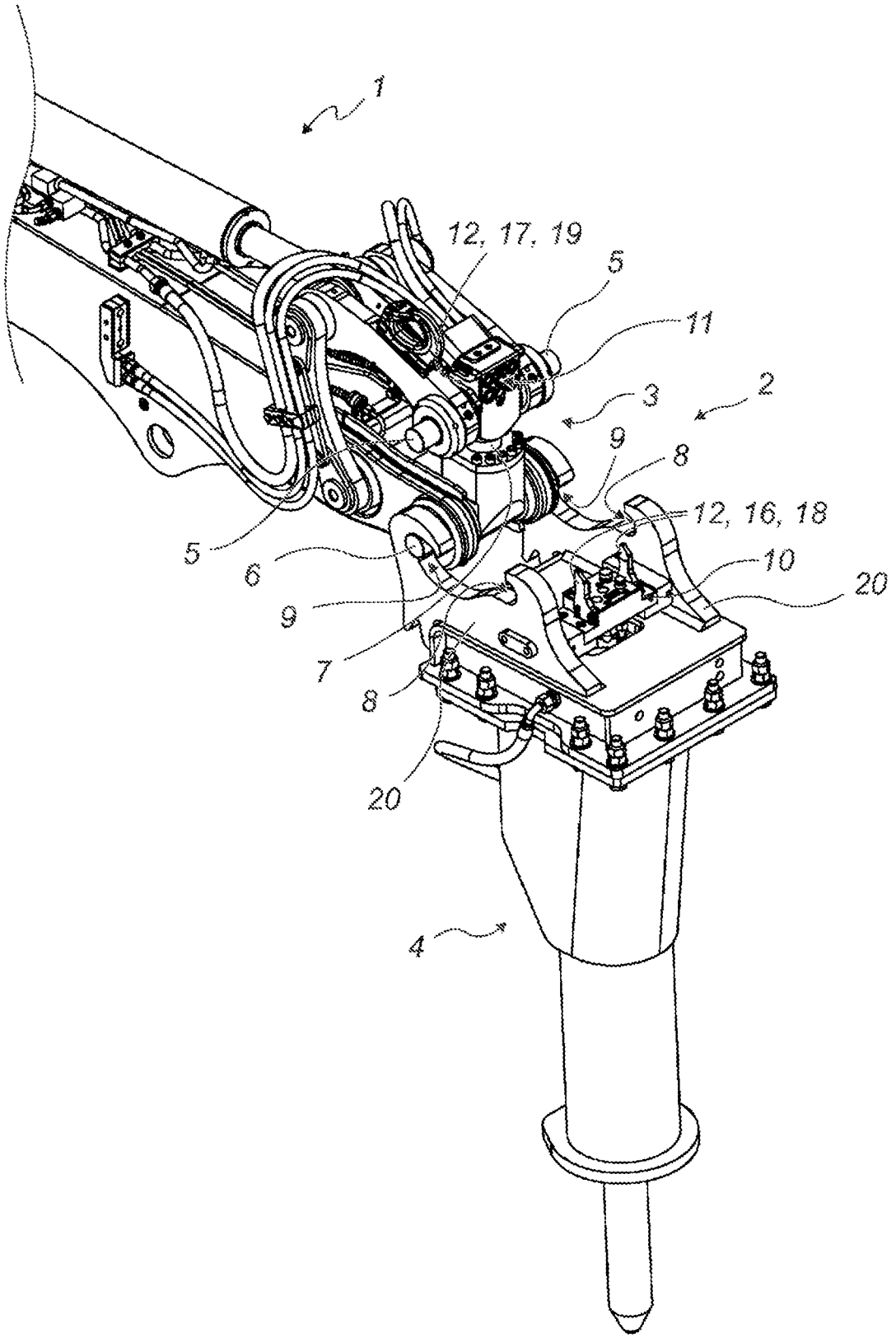
FIG. 1 is a perspective view of the stick of construction or public-works equipment equipped with an automatic connection device according to the invention, in which the tool holder is partially assembled with a rock breaker-type tool.

FIG. 1 shows a pivoted stick (1) of construction or public-works equipment equipped with an automatic connection device (2) according to the invention and a tool holder (3) provided on the free end of the pivoted stick (1) of construction or public-works equipment and partially assembled with a rock breaker-type tool (4).

This figure shows a specific tool holder (3) developed by the Applicant, which comprises a quick and reversible device for attachment of a tool to construction equipment. In this device, the tool holder (3) comprises two pairs of holding axles (5, 6) extending laterally and mobile by moving closer or farther apart by means of a locking cylinder (7), whereas the tool (4) comprises at least two pairs of receiving parts (8, 9) the openings of which are facing and each intended to receive one of the holding axles (5, 6).

The automatic connection device (2) according to the invention is provided to automatically connect and couple at least one of the electric, pneumatic and/or hydraulic networks of a tool (4) with at least one of those of the tool holder (3) when said tool (4) is mechanically mounted and assembled on the tool holder (3).

This automatic connection device (2) comprises a first connection plate (10) provided on the tool (4), a second connection plate (11) provided on the tool holder (3) and a centering device (12) provided on the tool holder (3) and/or on the tool (4).

The first connection plate (10) comprises at least one electric, pneumatic and/or hydraulic coupler (13) accessible from the outside and connected to at least one of the electric, pneumatic and/or hydraulic networks of the tool (4).

The second connection plate (11) comprises at least one electric, pneumatic and/or hydraulic coupler (14) accessible from the outside and connected to at least one of the electric, pneumatic and/or hydraulic networks of the tool holder (3).

At least one of the connection plates (10 or 11), called "fixed connection plate", is attached or integral to the tool (4) or the tool holder (3) on which it is provided so as to be immobile relative thereto. Preferably, it involves the second connection plate (11), which is provided on the tool holder (3).

The other connection plate (11 or 10), called "movable connection plate", is mounted mobile on the tool (4) or the tool holder (3) on which it is provided so as to be mobile both in pivoting and sliding relative thereto. Preferably, it involves the first connection plate (10) provided on the tool (4).

In the remainder of the description, for reasons of clarity, the movable connection plate will have the reference 10, whereas the fixed connection plate will have the reference 11. In fact, the figures show the invention according to a preferred embodiment in which the first connection plate (10) is the movable connection plate, while the second connection plate (11) is the fixed connection plate.

Although this variant is not shown in the figures, it must however be seen clearly by the reader that the invention can also be provided such that the first connection plate (10) is the fixed connection plate while the second connection plate (11) is the movable connection plate.

Figure 2:
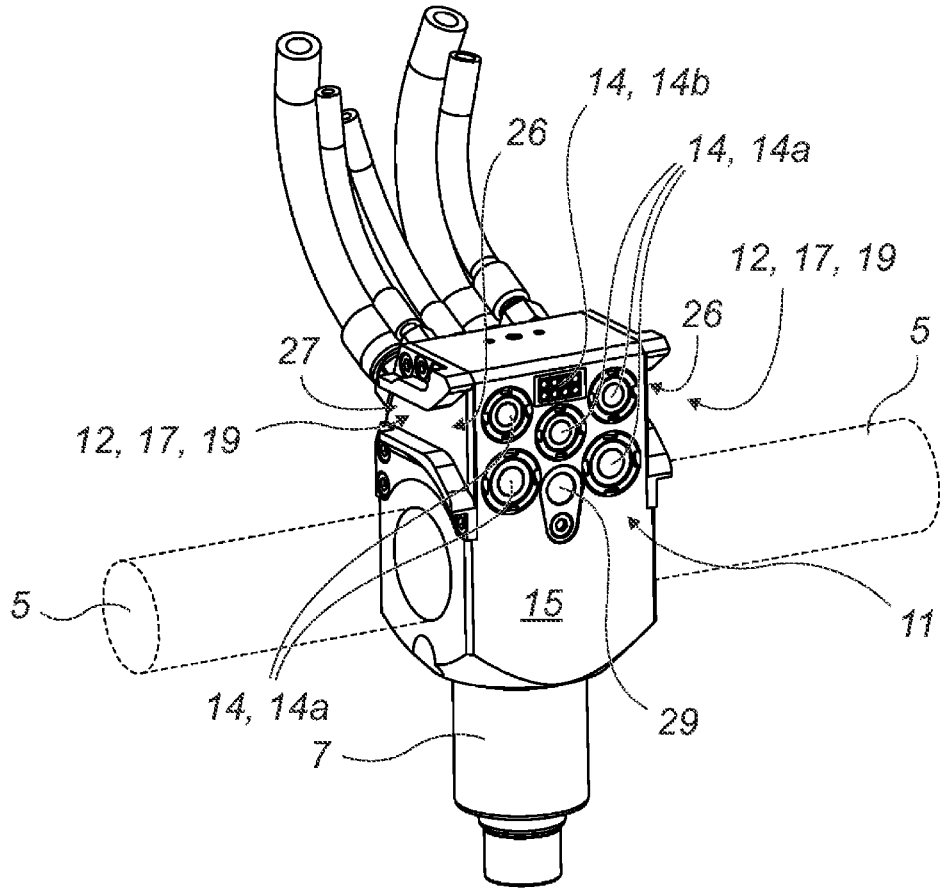
FIG. 2 is a perspective view of the part of the tool holder comprising a fixed connection plate according to the invention.

FIG. 2 shows the front face of a tool holder (3) comprising a fixed connection plate (11) according to the invention. In this example, the plate forms a single part with the part of the body (15) of the tool holder (3) on which it is mounted. The electric, pneumatic and/or hydraulic couplers (14) of the fixed connection plate (11) are preferably female couplers, such that no element of the fixed connection plate (11) projects beyond the part of the body (15) of the tool holder (3) on which it is mounted. In this figure given solely as an example, the fixed connection plate (11) comprises five female hydraulic couplers (14*a*) and one female electric coupler (14*b*) with eight pins.

Figure 3:
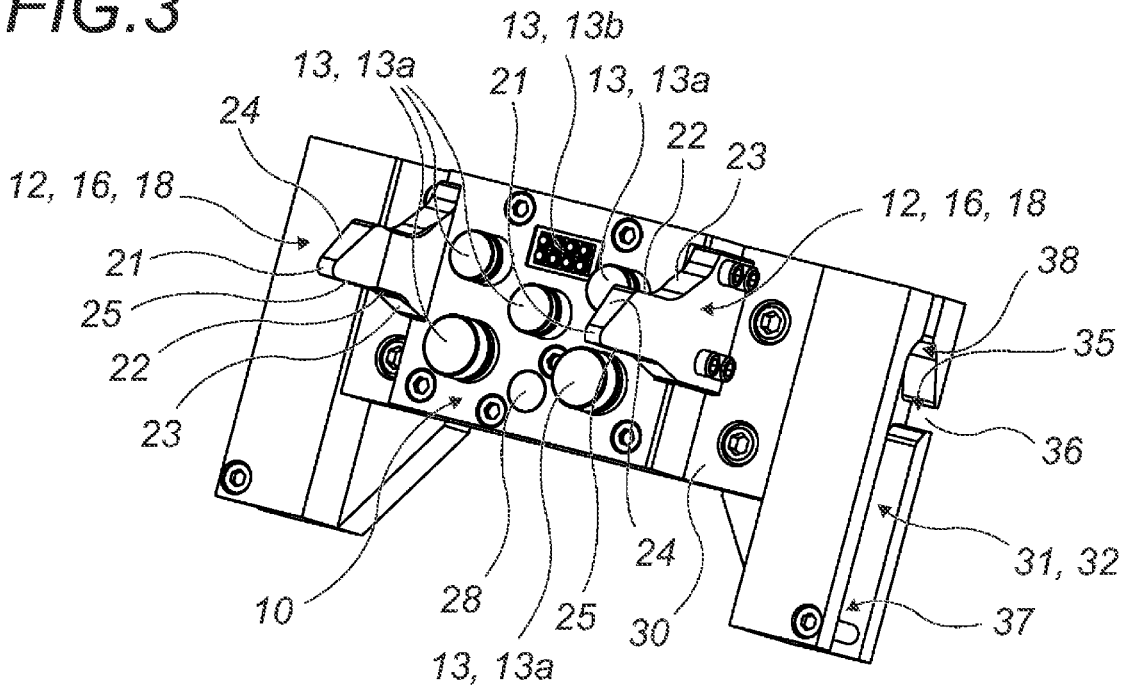
FIG. 3 is a perspective view of a movable connection plate according to the invention.

FIG. 3 shows a movable connection plate (10) according to the invention. In this example, the electric, pneumatic and/or hydraulic couplers (13) on the movable connection plate (10) are preferably male couplers. In this figure given solely as an example, the movable connection plate (10) comprises five male hydraulic couplers (13*a*) and one male electric coupler (13*b*) with eight pins.

The centering device (12) is provided such that, when said tool (4) is mechanically mounted and assembled on the tool holder (3), the first and second connection plates (10, 11) are mutually centered and the couplers (13, 14) thereof are mutually connected, so as to connect at least one of the electric, pneumatic and/or hydraulic networks of the tool (4) to that of the tool holder (3).

The centering device (12) is provided in order to be able to guide the movement of the movable connection plate (10) relative to the fixed connection plate (11) when said tool (4) is mechanically mounted and assembled on the tool holder (3) along a curved trajectory.

According to a preferred embodiment of the invention, the centering device (12) comprises at least one first guiding element (16) provided on the tool (4) immediately by or on the first connection plate (10), and at least one second guiding element (17) provided on the tool holder (3) immediately by or on the second connection plate (11).

The centering device (12) preferably comprises two guiding elements (16 or 17) provided on either side of the first connection plate (10) and two other guiding elements (17 or 16) provided on either side of the second connection plate (11).

According to a preferred embodiment of the invention, the first or second guiding element (16 or 17) is a projecting guiding finger (18), whereas the other guiding element (17 or 16) is a receiving housing (19) for said guiding finger (18), provided for housing the guiding finger (18) with a lateral play less than 2 millimeters, preferably less than 1 millimeter and more preferably less than 0.5 millimeter.

Preferably, each guiding element (16) provided on the tool (4) has the shape of a projecting guiding finger (18), while each guiding element (17) provided on the tool holder (3) has the shape of a receiving housing (19). As before, it is possible this way that no elements project beyond the part of the body (15) of the tool holder (3) on which the fixed connection plate (11) is mounted.

In fact, such projecting elements would be likely to be damaged during operation of the pivoted stick (1), whereas the projecting elements present on the back of the tool (4) can advantageously be protected by projecting parts (20) of the tool (4) in which the two pairs of receiving parts (8, 9) are shaped.

This configuration is of course valid for the specific tool holder (3) developed by the Applicant, which comprises a quick and reversible device for attachment of a tool to construction equipment.

When the centering device (12) comprises two guiding fingers (18), each receiving housing (19) can have an open outer lateral surface, such as shown in FIG. 2.

For a different tool holder (3), this configuration can consequently be adjusted without going outside the scope of the present invention.

Each guiding finger (18) preferably has the shape of a plate (15) having a thickness included between 5 and 30 mm, preferably included between 8 and 20 mm and more preferably included between 10 and 15 mm.

It preferably has a free end (21) which narrows to a point shape, followed by a straight median portion (22) continuing along the longitudinal axis of the guiding finger (18) and ending in a flared base (23) provided for mounting of the guiding finger (18) on or immediately by the connection plate on which it is provided (10). The tapered free end (21) of each guiding finger (18) comprises an inclined plane (24) directed forward and opposite a straight part (25) extending along the longitudinal axis of the guiding finger (18).

Each receiving housing (19) preferably comprises a flared entry (26) through which the guiding finger penetrates (18), followed by a straight part (27) extending along the longitudinal axis of the receiving housing (19) in order to receive said guiding finger (18) at least partially.

Each of the guiding fingers (18) and each of the receiving housings (19) is preferably provided in a vertical plane and they are preferably each extended along the longitudinal axis of the stick (1) of the construction or public-works equipment.

According to a preferred embodiment, each guiding finger (18) is provided on the movable connection plate (10) and has a generally straight shape.

According to a variant of the invention, the first connection plate (10) comprises an identification chip (28), preferably an RFID chip, while the second connection plate (11) comprises a chip reader (29).

The identification chip (28) can contain a lot of information, in particular an identification code specific to the tool allowing the tool holder to identify the tool which is connected to it and automatically adjust the equipment in order for the tool to be used according to the manufacturer's recommendations.

According to a preferred embodiment of the invention, the movable connection plate (10) comprises a base (30) mounted mobile on the tool (4) or the tool holder (3), where this base (30) comprises cutouts (31) each forming a guiding opening (32) and provided on either side of the movable connection plate (10), and said tool (4) or tool holder (3) comprises projecting elements (33) housed sliding in one of the cutouts (31).

Each projecting element (33) preferably has the shape of a pair of substantially cylindrical guiding rollers (34) each with a diameter that is substantially equal and slightly less than that of the internal height of the cutouts (31). The guiding rollers (34) are all provided in a single plane, where this plane is horizontal in the figures.

When the tool (4) is mounted on the tool holder (3), the cutouts (31) of the base (30) are located in a plane substantially orthogonal to the longitudinal axis of the stick (1) of the construction or public-works equipment.

Each cutout (31) preferably has an oblong shape and has a front end transversely flared (35) relative to the longitudinal axis of the cutout (31), where this flare (35) extends in the direction opposite the tool holder (3) when the tool (4) is mounted on the tool holder (3), meaning that in the figures the flare (35) extends downward and is located near the right end of the cutout (31).

Each cutout (31) is closed or plugged at each front and rear longitudinal end thereof in order to limit the range of the guiding rollers (34) therein, such that the movable connection plate (10) is always on the tool (4) in a position where the centering device (12) is provided in order to be able to guide the movement of the movable connection plate (10) relative to the fixed connection plate (11) when said tool (4) is mechanically mounted and assembled on the tool holder (3).

The flare (35) may comprise an open slit (36) provided for avoiding accumulation of dirt or sand in this part.

With reference to FIGS. 4 to 10, and in order to better understand the invention, we are now going to look at the operation of the automatic connection device (2) according to the invention equipped on a specific tool (4) and tool holder (3) developed by the Applicant, which comprises a quick and reversible device for attachment of a tool to construction equipment.

In these figures, the tool (4) is not shown in full, but only the base thereof is shown.

First, the tool (4) is partially engaged with the tool holder (3) and a pair of holding axles (6) of the tool holder (3) is received in a pair of receiving parts (9) of the tool (4).

Figure 4:
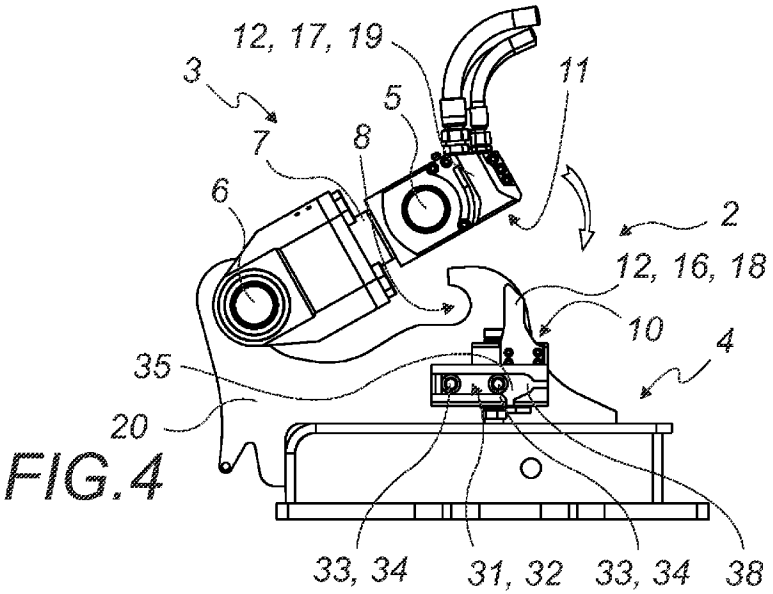
FIGS. 4 to 8 are profile views showing the sequences for holding and locking a tool by a tool holder, where these are equipped with an automatic connection device according to the invention.

Next, the other pair of holding axles (5) of the tool holder (3) is brought towards the other pair of receiving parts (8) of the tool (4) by pivoting (see FIG. 4).

The two connection plates (10, 11) are brought mutually closer and the free end (21) of each guiding finger (18) comes into contact with the flared entry (26) of the receiving housing (19) associated therewith.

The movable connection plate (10) is mounted floating on the tool (4), also the position thereof is variable when each guiding finger (18) comes into contact with the receiving housing (19) associated therewith.

The guiding opening (32) of the base (30) on which the movable connection plate (10) is provided and the guiding rollers (34) of the tool holder (3) are however provided such that in the various possible far positions of the movable connection plate (10) relative to the tool (4), when the other pair of holding axles (5) of the tool holder (3) is brought closer to the other pair of receiving parts (8) of the tool (4) by pivoting, the free end (21) of each guiding finger (18) always comes into contact with the flared entry (26) of the receiving housing (19) associated therewith.

Figure 5A:
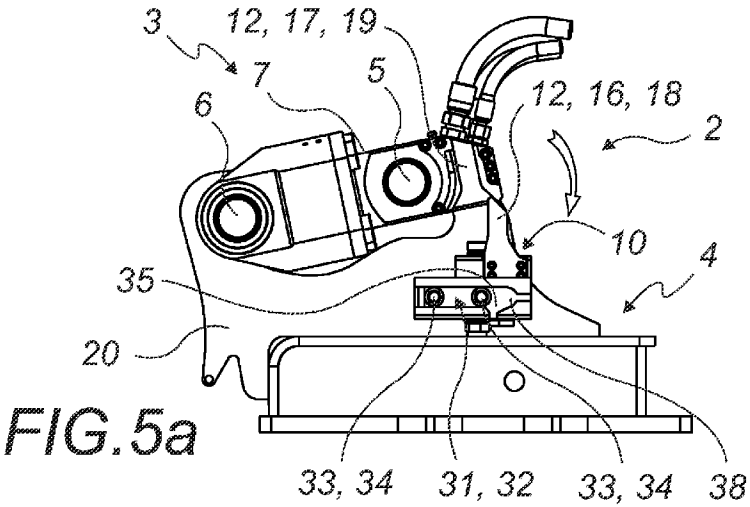
Figure 5B:
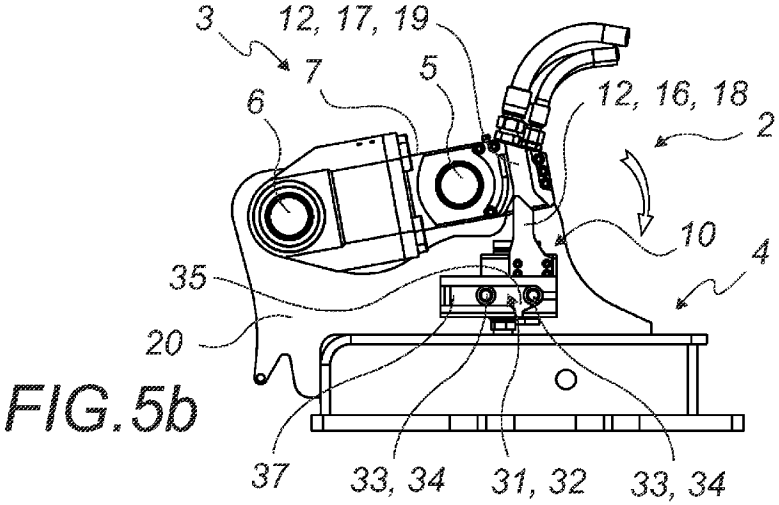
Figure 5C:
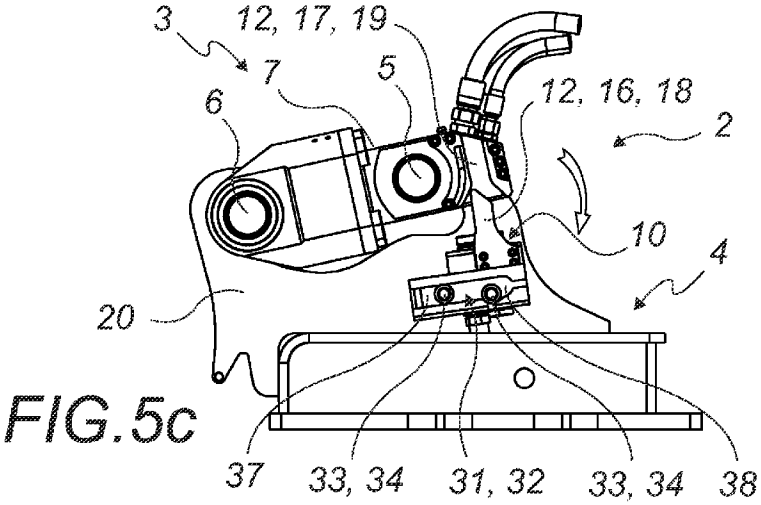
Figure 7:
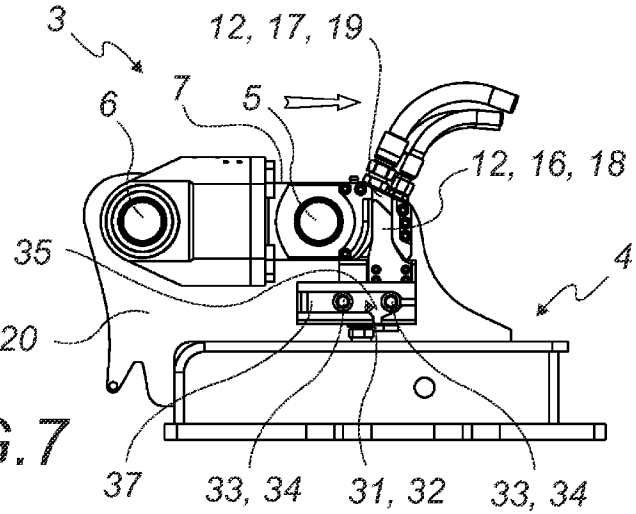
Figure 6:
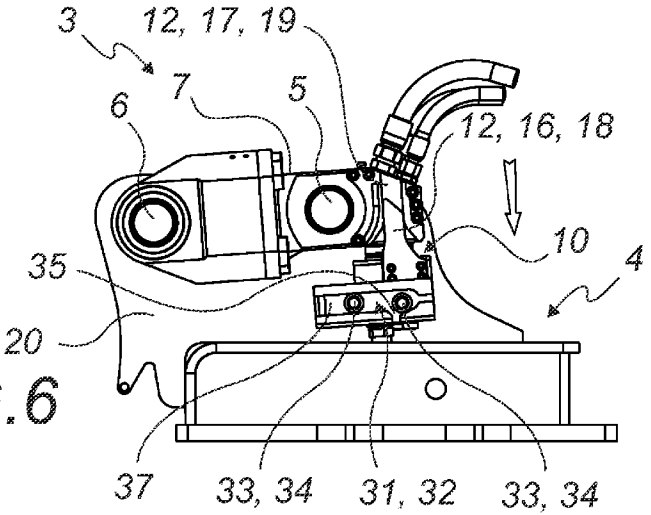
Figure 8:
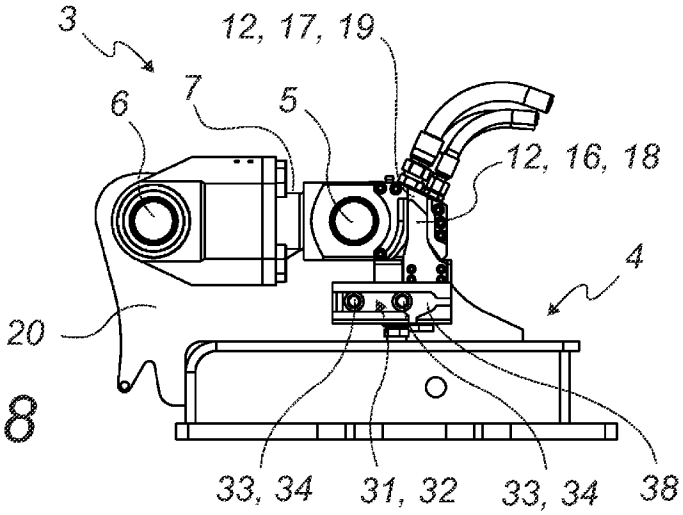

These various possible far positions for the movable connection plate (10) relative to the tool (4) are shown in FIGS. 5*a*, 5*b* and 5*c*.

In FIG. 5*a*, the movable connection plate (10) is in far front position relative to the tool (4), meaning that it is in far position to the right in the figure, where the guiding rollers (34) are stopped against the rear part (37) of the guiding opening (32) of the base (30) on which the movable connection plate (10) is provided. In this position, when the two connection plates (10, 11) are brought mutually closer, the inclined plane (24) of each guiding finger (18) slides by sliding on the flared entry (26) of the receiving housing (19) associated therewith. This sliding of one ramp against another slides the base (30) on which the movable connection plate (10) is provided such that each guiding finger (18) is positioned substantially centered relative to the receiving housing (19) associated therewith.

In FIG. 5*b*, the movable connection plate (10) is in far rear position relative to the tool (4), meaning that it is in far position to the left in the figure, where the guiding rollers (34) are stopped against the front part (38) of the guiding opening (32) of the base (30) on which the movable connection plate (10) is provided. In this position, when the two connection plates (10, 11) are brought mutually closer, each guiding finger (18) slides by sliding on the flared entry (26) of the receiving housing (19) associated therewith. This sliding slide the base (30) on which the movable connection plate (10) is provided such that each guiding finger (18) is positioned substantially centered relative to the receiving housing (19) associated therewith.

In FIG. 5*c*, the movable connection plate (10) is in far pivoted position relative to the tool (4), meaning that a pair of guiding rollers (34) is stopped in the bottom of the flare (35) of each cutout (31) of the base (30) on which the movable connection plate (10) is provided. In this position, when the two connection plates (10, 11) will be brought mutually closer, each guiding finger (18) slides by sliding on the flared entry (26) of the receiving housing (19) associated therewith. This sliding pivot the base (30) on which the movable connection plate (10) is provided such that each guiding finger (18) is positioned substantially centered relative to the receiving housing (19) associated therewith.

When the two connection plates (10, 11) are brought towards each other, each guiding finger (18), centered relative to the receiving housing (19) associated therewith, slides by sliding in the receiving housing (19) thereof. During this movement, the movable connection plate (10) pivots and slides relative to the tool (4) to follow the movement (see FIG. 6).

The two connection plates (10, 11), perfectly centered because of the centering device (12), come mutually closer by a substantially straight translational movement relative to each other until coming into contact. The electric, pneumatic and/or hydraulic couplers (13, 14) of the connection plates (10, 11) then mutually engage in order to connect the respective electric, pneumatic and/or hydraulic networks thereof. In this position, one pair of holding axles (6) of the tool holder (3) is received in one pair of receiving parts (9) of the tool (4) whereas the other pair of holding axles (5) of the tool holder (3) is opposite the other pair of receiving parts (8) of the tool (4) (see FIG. 7). All the holding axles (5, 6) of the tool holder (3) are in the same plane as the receiving parts (8, 9) of the tool (4). The rollers are in far position stopped against the front part (38) (to the right in the figure) of each guiding opening (32) of the base (30).

The tool (4) is then locked on the tool holder (3) by the translational displacement of the other pair of holding axles (5) of the tool holder (3) to the bottom of the receiving parts (8) of the tool (4) by means of the locking cylinder (7). The two connection plates (10, 11) remain connected and the movable connection plate (10) slides forward relative to the tool (4) in order to follow the movement (see FIG. 8). The rollers are then found in far position stopped against the rear part (37) (to the left in the figure) of each guiding opening (32) of the base (30), which corresponds to the locked position of the tool (4) on the tool holder (3).

Figure 9:
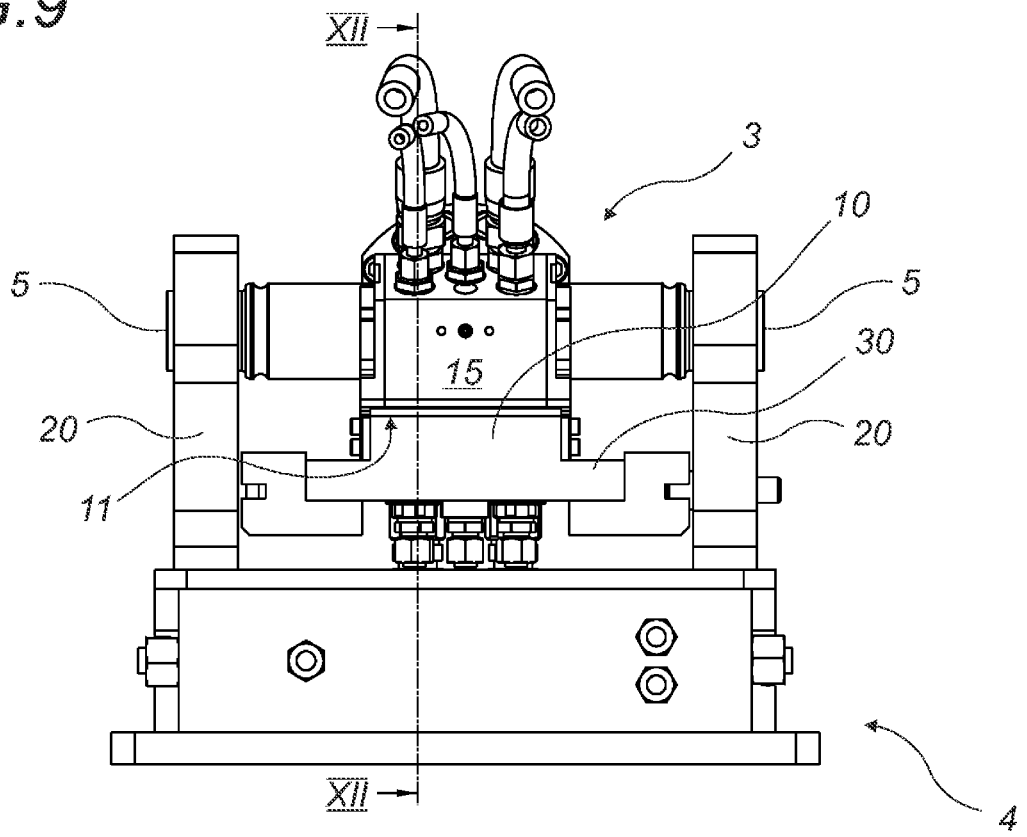
FIG. 9 is a front view of a tool assembled on a tool holder, where they are equipped with an automatic connection device according to the invention.
Figure 10:
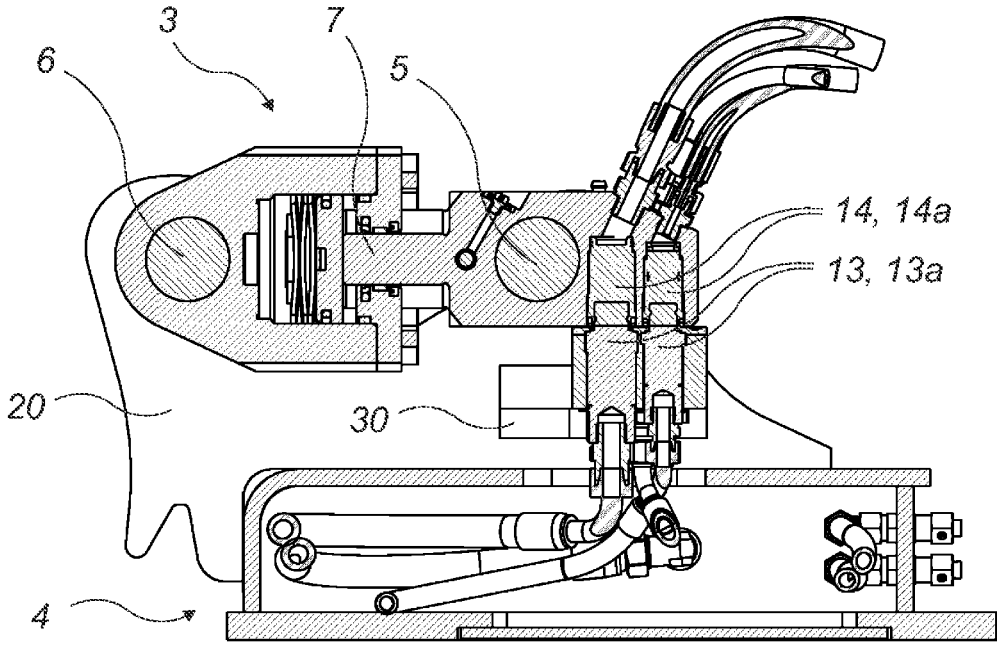
FIG. 10 is a profile view of a tool assembled on a tool holder shown in section along the section axis shown in FIG. 9.

This position is also shown from the front in FIG. 9 and in section in FIG. 10, where it is notably possible to see that the electric, pneumatic and/or hydraulic couplers (13, 14) of the connection plates (10, 11) are all mutually connected.

We are reminded that the automatic connection device (2) according to the invention is not provided solely for the specific tool holder (3) developed by the Applicant, which comprises a quick and reversible device for attachment of a tool to construction equipment. Consequently, the operation of the invention described above can be substantially different depending on the configuration of the tool (4) and the tool holder (3).

Similarly, a tool holder (3) equipped with an automatic connection device (2) according to the invention can also be used for assembly with a tool (4) not requiring any connection to any electric, pneumatic and/or hydraulic network.

In this case, a first possibility consists in that the second connection plate (11) provided on the tool holder (3) is equipped with a protective device (39), for example in the form of a stiff metal protective cover equipped with a flexible rubber-type plate, which is placed above the electric, pneumatic and/or hybrid couplers (14) of the second connection plate (11). This protective device (39) is placed manually.

A second possibility consists in that the tool (4) is equipped with a protective device (40) coming to bear on the second connection plate (11) provided on the tool holder (3) in order to protect it. This protective device (40) can have the shape of a block of rubber or equivalent, which can have projecting elements provided for engaging with the electric, pneumatic and or hydraulic couplers (14) of the second connection plate (11). This protective device (40) stays on the tool (4).

Figure 11:
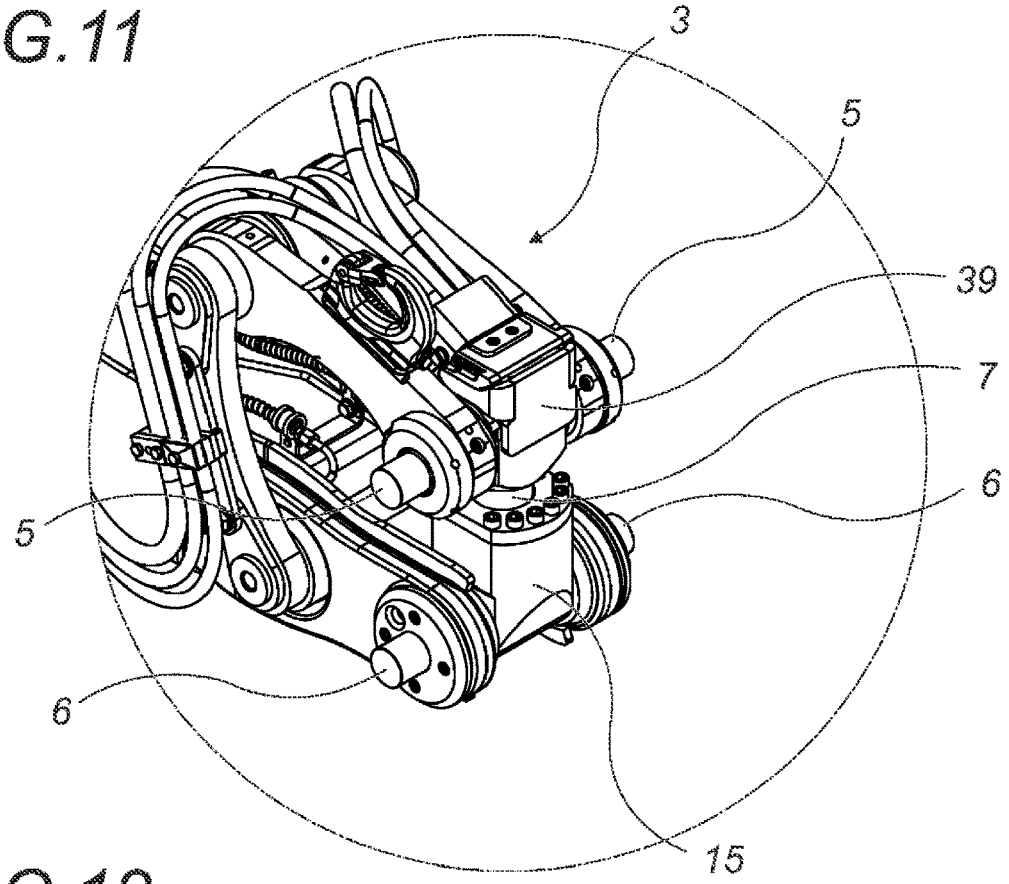
FIG. 11 is a perspective view of a stick of a construction or public-works equipment item equipped with an automatic connection device according to the invention, wherein the fixed connection plate is equipped with a protective element.
Figure 12:
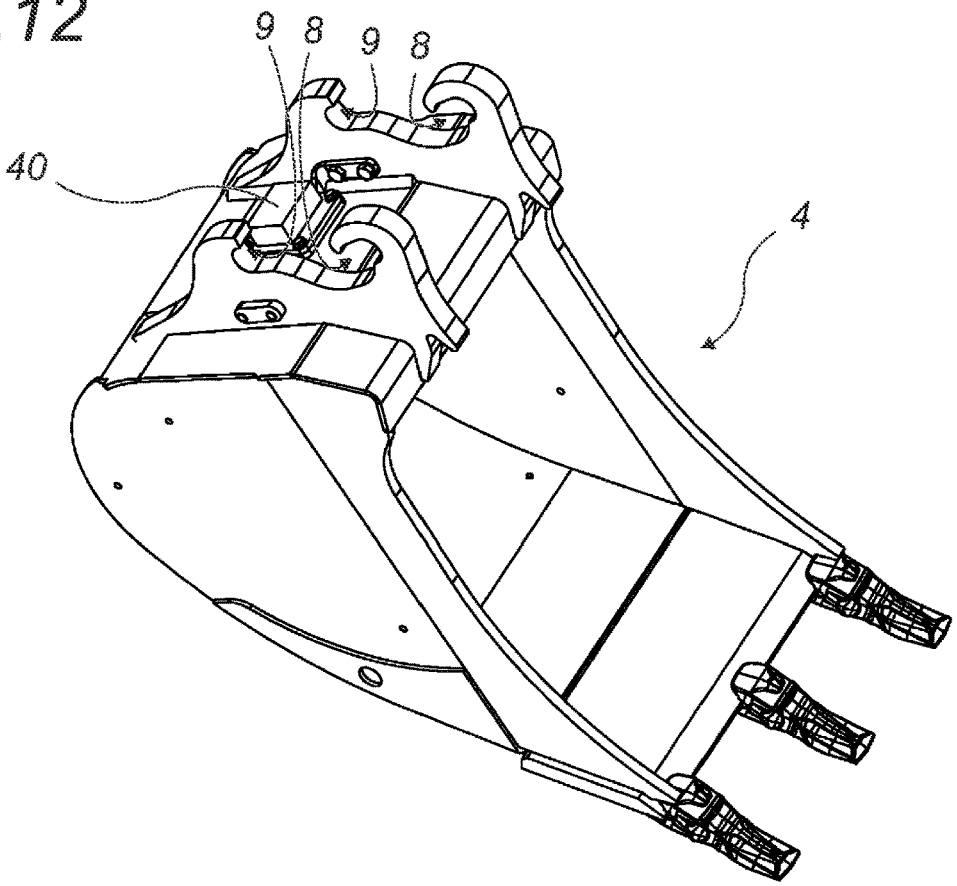
FIG. 12 is a perspective view of a construction site tool in the form of a reversible bucket equipped with an automatic connection device according to the invention, wherein the movable connection plate is equipped with a protective element.

A tool holder (3) equipped with an automatic connection device (2) according to the invention for which the second connection plate (11) is equipped with a protective device (39) is shown in FIG. 11, while FIG. 12 shows a reversible bucket equipped with the protective device (40).

It will be noted that both protective devices (39, 40) described above are two alternatives aiming to protect the automatic connection device (2) according to the invention for a tool (4) not requiring connection to an electric, pneumatic and/or hydraulic network.

It is obvious that this description is not limited to the examples explicitly described, but also includes other embodiments and/or implementations. Thus, one described technical characteristic can be replaced by an equivalent technical characteristic without going beyond the scope of the invention, and one described functional step of implementation of the method can be replaced by an equivalent step without departing from the scope of the invention.

The invention claimed is:

1. An automatic connection device allowing connecting and automatically coupling at least one of the electric, pneumatic and/or hydraulic networks of a tool with at least one of those of a tool holder provided on the free end of the stick of construction or public-works equipment when said tool is mechanically mounted and assembled on the tool holder, this automatic connection device comprising:

a first connection plate provided on the tool, comprising at least one electric, pneumatic and/or hydraulic coupler accessible from the outside and connected to at least one of the electric, pneumatic and/or hydraulic networks of said tool;

a second connection plate provided on the tool holder, comprising at least one electric, pneumatic and/or hydraulic coupler accessible from the outside and connected to at least one of the electric, pneumatic and/or hydraulic networks of said tool holder;

a centering device provided on the tool holder and/or on the tool such that, when said tool is mechanically mounted and assembled on the tool holder, the first and second connection plates are mutually centered and the couplers thereof are mutually connected, so as to connect at least one of the electric, pneumatic and/or hydraulic networks of the tool to that of the tool holder;

wherein:

at least one of the connection plates, called a fixed connection plate, is attached or integral to the tool or the tool holder on which said fixed connection plate is provided so as to be immobile relative thereto; and the other connection plate, called a movable connection plate, is mounted mobile on the tool or the tool holder on which said movable connection plate is provided so as to be mobile both in pivoting and sliding relative thereto, and further comprising:

two guiding elements provided on either side of the first connection plate and two other guiding elements provided on either side of the second connection plate, the first or second guiding element being a projecting guiding finger, whereas the other guiding element is a receiving housing for said guiding finger, provided for housing the guiding finger, and further wherein each guiding finger has a free end that narrows to a point shape, followed by a straight median portion extending along the longitudinal axis of the guiding finger and ending in a flared base provided for mounting of the guiding finger on or immediately by the connection plate at which it is provided.

2. The automatic connection device according to claim 1, wherein the centering device guides the movement of the movable connection plate relative to the fixed connection plate along a curved trajectory when the tool is mechanically mounted and assembled on the tool holder.

3. The automatic connection device according to claim 1, wherein the centering device comprises at least one first guiding element provided on the tool immediately by or on the first connection plate, and at least one second guiding element provided on the tool holder immediately by or on the second connection plate.

4. The automatic connection device according to claim 3, further comprising two guiding elements provided on either side of the first connection plate and two other guiding elements provided on either side of the second connection plate.

5. The automatic connection device according to claim 1, wherein the tapered free end of each guiding finger comprises an inclined plane directed forward and opposite a straight part extending along the longitudinal axis of the guiding finger.

6. The automatic connection device according to claim 1, wherein each guiding finger is provided on the movable connection plate.

7. The automatic connection device according to claim 1, wherein the first connection plate is mounted mobile on the tool whereas the second connection plate is attached or integral to the tool holder.

8. The automatic connection device according to claim 1, wherein the first connection plate comprises an identification chip, while the second connection plate comprises a chip reader.

9. The automatic connection device according to claim 1, wherein the movable connection plate comprises a base mounted mobile on the tool or the tool holder, where this base comprises cutouts each forming a guiding opening and provided on either side of the movable connection plate, and wherein said tool or tool holder comprises projecting elements, where each of these projecting elements is housed sliding in one of the cutouts.

10. The automatic connection device according to claim 9, wherein each projecting element preferably has the shape of a pair of substantially cylindrical guiding rollers each with a diameter that is substantially equal and slightly less than that of the internal height of the cutouts.

11. The automatic connection device according to claim 9, wherein when the tool is mounted on the tool holder, the cutouts of the base are located in a plane substantially orthogonal to the longitudinal axis of the stick of the construction or public-works equipment.

12. The automatic connection device according to claim 9, wherein each cutout has an end transversely flared relative to the longitudinal axis of the cutout, where this flare extends in the direction opposite the tool holder when the tool is mounted on the tool holder.

13. Construction or public-works equipment comprising a stick equipped with a tool holder carrying a tool, further comprising an automatic connection device according to claim 1.

* * * * *